United States Patent [19]

Mizuma

[11] 4,153,242

[45] May 8, 1979

[54] SHEET FEED APPARATUS

[75] Inventor: Kenichi Mizuma, Tokyo, Japan

[73] Assignee: Ricoh Company, Ltd., Tokyo, Japan

[21] Appl. No.: 844,861

[22] Filed: Oct. 25, 1977

[30] Foreign Application Priority Data

Oct. 29, 1976 [JP] Japan ..... 51-131095

[51] Int. Cl.[2] ..... B65H 1/26; B65H 1/14

[52] U.S. Cl. ..... 271/9; 271/157; 271/164

[58] Field of Search ..... 271/157, 158, 159, 162, 271/163, 164, 126, 9, 147, 152–156, 30 R; 214/8.5 A

[56] References Cited

U.S. PATENT DOCUMENTS 3,599,966 8/1971 Del Vecchio et al. ..... 271/9

*Primary Examiner*—Bruce H. Stoner, Jr.

*Attorney, Agent, or Firm*—Frank J. Jordan

[57] ABSTRACT

Upper and lower sheet carriages are rollingly supportable on upper and lower pairs of horizontal rails respectively. Each carriage supports a stack of sheets for a copying machine or the like. A drive comprising endless chains rolls one of the carriages to a lift position above an elevator and the other of the carriages to a loading position spaced from the elevator. The elevator is raised to lift a carriage from the lift position to a sheet feed position above the upper rails. The spacing between the lower rails is sufficiently smaller than that between the upper rails that the lower carriage may be raised through the upper rails by the elevator.

6 Claims, 2 Drawing Figures

SHEET FEED APPARATUS

BACKGROUND OF THE INVENTION

The present invention relates to a sheet feed apparatus for an electrostatic copying machine, duplicating machine or the like.

In a typical copying machine, copy sheets are provided in a stack on a tray and fed therefrom one by one as required by the copying process. When the sheets are depleted or it is desired to utilize sheets of a different size, it is necessary to interrupt the copying process and replace the sheets with a new stack of appropriate size. This replacement operation is inefficient and results in considerable wasted time.

SUMMARY OF THE INVENTION

The present invention overcomes this problem by providing two sheet carriages which run on upper and lower rails respectively. A chain drive means reciprocates the carriages between a lift position above an elevator and a loading position spaced from the elevator in such a manner that when one carriage is in the lift position the other carriage is in the loading position. The elevator lifts whichever carriage is in the lift position above the upper rails to a sheet feed position. The spacing between the lower rails is sufficiently smaller than that between the upper rails that the lower carriage may be raised through the upper rails by the elevator.

It is an object of the present invention to provide a sheet feed apparatus which allows extremely fast replacement of a stack of sheets in an electrostatic copying machine or the like.

It is another object of the present invention to provide a sheet feed apparatus comprising two sheet carriages. One carriage may be loaded with sheets while sheets on the other carriage are being consumed. The carriages are interchangeable with greatly improved speed and efficiency.

It is another object of the present invention to provide a generally improved sheet feed apparatus for an electrostatic copying machine or the like.

Other objects, together with the foregoing, are attained in the embodiment described in the following description and illustrated in the accompanying drawing.

DESCRIPTION OF THE PREFERRED EMBODIMENT

While the sheet feed apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
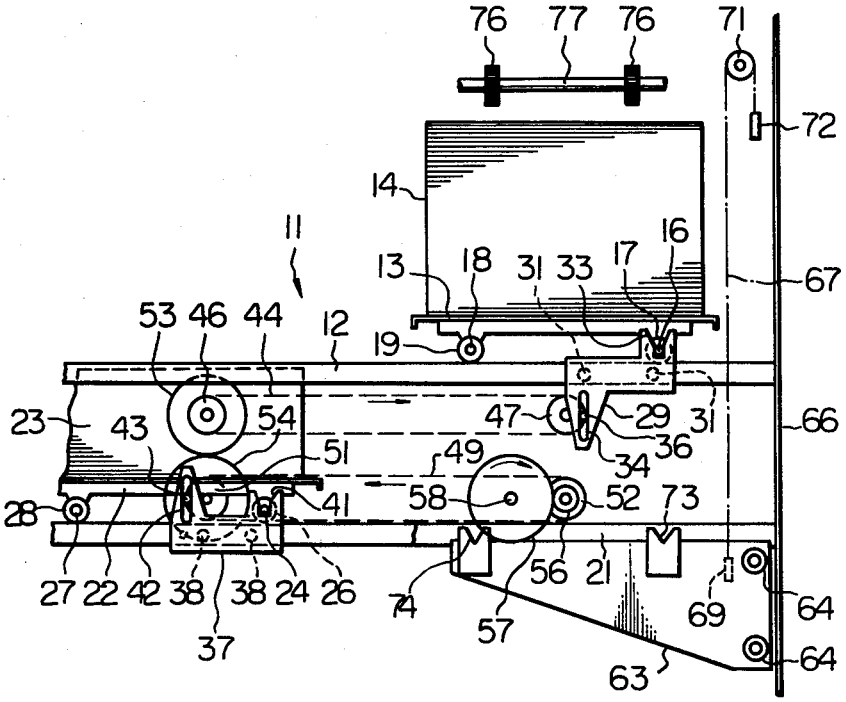
FIG. 1 is a side elevation of a sheet feed apparatus embodying the present invention.
Figure 2:
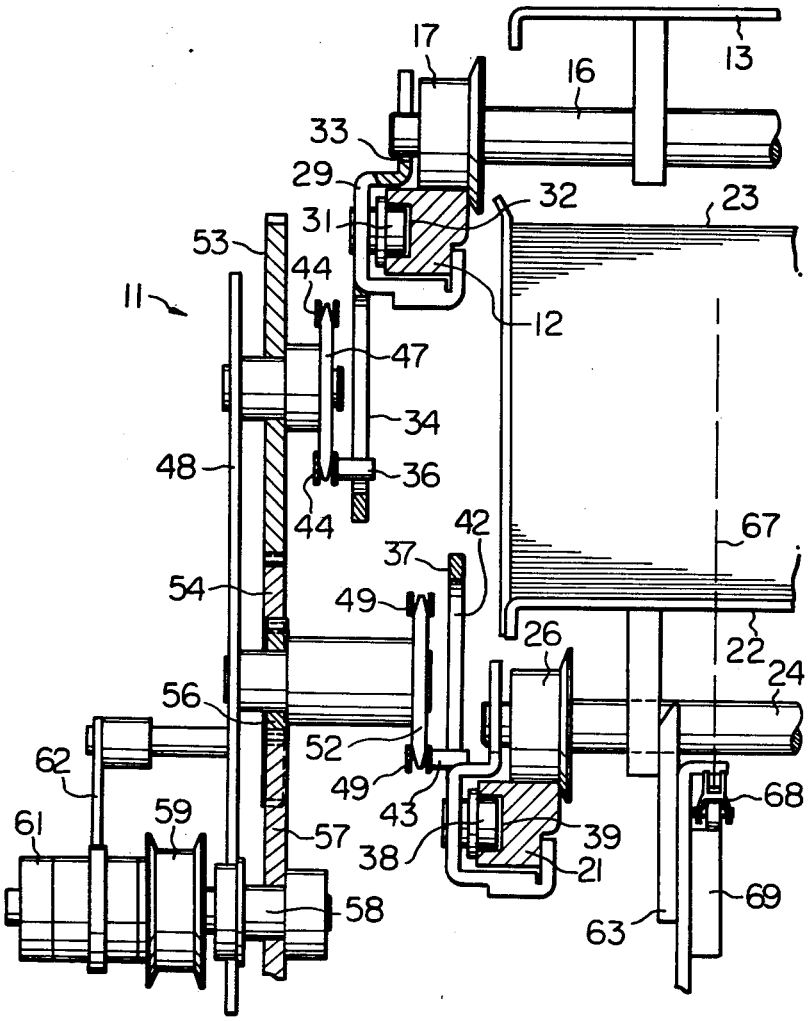
FIG. 2 is a front elevation, partially cut away, of the present sheet feed apparatus.

Referring now to FIGS. 1 and 2 of the drawing, a sheet feed apparatus embodying the present invention is generally designated by the reference numeral 11 and comprises a pair of upper, horizontally extending parallel rails 12, although only one of the rails 12 is visible in the drawing. An upper sheet carriage 13 which rollingly runs on the rails 12 supports a stack of sheets 14 for an electrostatic copying process or the like. The carriage 13 is provided with a front axle 16, front wheels 17, a rear axle 18 and rear wheels 19, although only one each of the wheels 17 and 19 is visible in the drawing. Similarly, a pair of lower rails 21 is provided directly below the upper rails 12. A lower sheet carriage 22 which rollingly runs on the rails 21 supports a stack of sheets 23. The lower carriage 22 is provided with a front axle 24, front wheels 26, a rear axle 27 and rear wheels 28.

As best seen in FIG. 2 an upper slider 29 is rollingly supported by the visible upper rail 12 by means of rollers 31 which engage in a cutout 32 in the side of the visible upper rail 12. The upper slider 29 is formed with an upwardly facing cutout 33 in which an end portion of the front axle 16 extending externally of the wheel 17 is engageable as illustrated. The upper slider 29 is further formed with a vertically elongated slot 34 in which a pin 36 slidably engages.

In an essentially similar manner a lower slider 37 is slidably supported by the visible lower rail 21 by means of rollers 38 which engage in a cutout 39 formed in the side of the rail 21. The lower slider 37 is formed with an upwardly facing cutout 41 in which an end portion of the axle 24 external of the wheel 26 is engageable. The lower slider 37 is further formed with a vertically elongated slot 42 in which a pin 43 slidably engages.

An upper endless chain 44 is trained around sprockets 46 and 47 and extends parallel to the upper rails 12 as illustrated. The sprockets 46 and 47 are rotatably supported by an upstanding plate 48. The pin 36 is fixed to the side of the chain 44 and extends transversely therefrom into the slot 34 of the slider 29. In an essentially similar manner, a lower endless chain 49 is trained around sprockets 51 and 52 which are rotatably supported by the plate 48. The pin 43 is fixed to the side of the chain 49 and extends transversely therefrom into the slot 42 of the slider 37.

Intermeshing gears 53 and 54 are integrally incorporated with the sprockets 46 and 51 respectively. A gear 56 is integrally incorporated with the sprocket 52 and meshes with a large gear 57 which is rotatably supported by the plate 48 by means of a shaft 58 on which the gear 57 is fixed. The shaft 58 is rotatable clockwise as viewed in FIG. 1 by means of a pulley 59 which is constantly driven from a motor (not shown). The pulley 59 is connected to the shaft 58 through a one-rotation clutch 61 operated by a latching arm 62. With the arm 62 engaged with the clutch 61, the clutch 61 is disengaged and the shaft 58 is prevented from rotation.

The apparatus 11 further comprises an elevator 63 which is vertically movable through the rails 12 and 21. The elevator 63 is guided by means of rollers 64 which engage in suitable vertically extending tracks (not shown) provided to an upstanding plate 66. A chain 67 is fixed at its lower end to the elevator 63 through a clevis 68 and lug 69. A counterweight 72 is provided at the upper end of the chain 67, which is trained around a sprocket 71. A suitable motor is provided to rotate the sprocket 71, although not illustrated. The elevator 63 is provided with upwardly facing cutouts 73 and 74 in which the axles of the carriages engage as will be described below. A pair of feed rollers 76 are fixed to a shaft 77 which is rotatably and drivingly mounted above the elevator 63.

In accordance with an important feature of the present invention, the gauge, or the distance between the lower rails 21 is sufficiently smaller than the distance between the upper rails 12 that the lower carriage 22 may be vertically moved through (between) the upper rails 12. It will be assumed for purposes of description of the operation of the apparatus 11 that the stack of sheets 14 on the upper carriage 13 has been depleted and it is desired to replace the sheets 14 with the sheets 23 loaded on the carriage 22. As illustrated in FIG. 1, the carriage 13 is in a lift position above the elevator 63 and the carriage 22 is in a loading position spaced from the elevator 63. In the loading position, the carriage 22 is accessible to the apparatus operator for loading sheets thereon.

Although not illustrated in the drawing, the elevator 63, in order to feed the sheets 14 from the carriage 13, is raised from the position shown in FIG. 1 upwardly through the rails 21 and 12 to engage and lift the carriage 13 from the lift position illustrated off the rails 12 so that the upper sheet 14 engages the feed rollers 76. More specifically, the cutouts 73 and 74 engage the axles 16 and 18 of the carriage 13 for supporting the same. The pressure of the sheets 14 against the rollers 76 is appropriately sensed, and the sprocket 71 is progressively rotated clockwise to raise the elevator 63 and carriage 13 so that the upper sheet 14 is always maintained in pressing engagement with the feed follers 76. The sheets 14 are fed one by one by the rollers 76 for use in the copying machine (not shown) until depleted.

The depletion of the sheets 14 is detected by an appropriate sensor such as a microswitch (not shown), which triggers the sprocket 71 to be driven counterclockwise to lower the elevator 63 by means of the chain 67. The elevator 63 is lowered to the position shown in FIG. 1 below the rails 21. Then, the arm 62 is momentarily disengaged from the clutch 61 to allow the shaft 58 to be driven for one rotation by the pulley 59. The gear is thereby driven for one clockwise rotation causing the chain 49 to rotate counterclockwise as indicated by an arrow. The circumferences of the gear 57 and chain 49 in addition to the diameters of the gear 56 and sprockets 51 and 52 are selected so that when the gear 57 rotates by one revolution the chain 49 rotates by one-half revolution. Thus, the pin 43 is moved from its leftmost position as illustrated to its rightmost position rightward of the sprocket 52. Due to the engagement of the pin 43 in the slot 42 of the slider 37, the slider 37 and lower carriage 22 are moved rightwardly from the loading position as illustrated to a lift position above the elevator 63.

Engagement of the gears 53 and 54, which preferably have the same diameter, causes the chain 44 to rotate clockwise by one-half revolution. The pin 36 is moved from its rightmost position as illustrated to its leftmost position to the right of the sprocket 46. Due to the engagement of the pin 36 in the slot 34, the slider 29 and upper carriage 13 are moved from the lift position as illustrated to a loading position which is above the illustrated position of the carriage 22. The elevator 63 is then raised to lift the lower carriage 22 and sheets 23 through the rails 21 and 12 into the sheet feed position in engagement with the feed rollers 76. At the beginning and end of movement of the carriages 13 and 22, due to the arrangement of the pins 36 and 43 in the slots 34 and 42, the carriages accelerate and decelerate respectively in a gradual, sinusoidal manner, thus preventing the stacks of sheets 14 and 23 from being disrupted or knocked over by inertia forces.

The operation of replacing the sheets 23 on the carriage 22 with the sheets 14 on the carriage 13 is essentially similar to that just described. The carriage 22 is lowered onto the rails 21 by the elevator 63, the chains 44 and 49 rotated by one revolution to move the carriages 13 and 22 to the lift and loading positions respectively, and the elevator 63 is raised to move the sheets 14 into engagement with the rollers 76. It will be noted that as a unique feature of the present invention the carriages 13 and 22 are reciprocated in opposite directions by the chains 44 and 49 in such a manner that one carriage is moved to the loading position while the other carriage is moved to the lift position. Whichever carriage is in the lift position is raised by the elevator 63 into the sheet feed position. The operation of exchanging the carriages may be initiated automatically upon detection of depletion of sheets or manually by pressing a button.

In summary, it will be seen that the present invention provides a fast and automatic apparatus by which sheets in a copying machine may be replaced automatically in a very short period of time, thus substantially increasing the speed and efficiency of the copying process. Various modifications will become possible for those skilled in the art after receiving the teachings of the present disclosure without departing from the scope thereof.

What is claimed is:

1. A sheet feed apparatus comprising:

an upper pair of horizontal rails;

an upper sheet carriage rollingly supportable on the upper rails;

a lower pair of horizontal rails disposed directly below the upper rails;

a lower sheet carriage rollingly supportable on the lower rails, the upper rails being spaced further apart than the lower rails to such an extent that the lower carriage may pass vertically between the upper rails;

an elevator which is vertically movable through the lower and upper rails;

carriage drive means for integrally rolling the upper carriage to a carriage lift position above the elevator and the lower carriage to a carriage loading position spaced from the elevator;

elevator drive means for vertically moving the elevator to liftingly engage and move upper carriage between the lift position thereof and a sheet feed position above the upper rails; and the carriage drive means being further operative to integrally roll the upper carriage to a carriage loading position spaced from the elevator and the lower carriage to a carriage lift position above the elevator, the elevator drive means being further operative to vertically move the elevator to liftingly engage and move the lower carriage between the lift position thereof and said sheet feed position above the upper rails.

2. An apparatus as in claim 1, in which the upper and lower carriages each comprise an axle, the carriage drive means comprising upper and lower sliders slidably supported by the upper and lower rails and being formed with upwardly facing cutouts into which the axles of the upper and lower carriages are engageable respectively, the carriage drive means further comprising slider drive means for integrally moving the upper and lower sliders in opposite directions.

3. An apparatus as in claim 2, in which the upper and lower sliders are each formed with an elongated slot, the slider drive means comprising an endless chain means and first and second pins fixed to the chain means, the first and second pins slidably engaging in the slots of the upper and lower sliders respectively.

4. An apparatus as in claim 3, in which the chain means comprises upper and lower endless chains extending parallel to the upper and lower guide rails, the first and second pins being fixed to the upper and lower chains respectively, the chain means further comprising gear means interengaging the upper and lower chains for integral movement.

5. An apparatus as in claim 4, in which the slider drive means comprises a one-rotation clutch for producing a one-half rotation of the upper and lower chains.

6. An apparatus as in claim 2, in which the elevator is formed with an upwardly facing cutout into which the axles of the upper and lower carriages are engageable.

* * * * *